US008957391B2

(12) United States Patent
Kholomeev

(10) Patent No.: US 8,957,391 B2
(45) Date of Patent: Feb. 17, 2015

(54) RF TRANSFORMER

(71) Applicant: Thermo Fisher Scientific (Bremen) GmbH, Bremen (DE)

(72) Inventor: Alexander Kholomeev, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/256,772

(22) Filed: Apr. 18, 2014

(65) Prior Publication Data

US 2014/0224998 A1 Aug. 14, 2014

Related U.S. Application Data

(63) Continuation of application No. 13/841,912, filed on Mar. 15, 2013, now Pat. No. 8,704,193.

(30) Foreign Application Priority Data

Nov. 16, 2012 (GB) ..... 1220655.3
Nov. 16, 2012 (GB) ..... 1220659.5
Nov. 16, 2012 (GB) ..... 1220661.1

(51) Int. Cl.
*H01F 19/04* (2006.01)
*H01J 49/02* (2006.01)
*H01J 49/00* (2006.01)
*H01F 38/14* (2006.01)

(52) U.S. Cl.
CPC ..... *H01J 49/022* (2013.01); *H01F 19/04* (2013.01); *H01J 49/00* (2013.01); *H01F 38/14* (2013.01)
USPC ..... 250/396 R; 250/292

(58) Field of Classification Search
USPC ..... 250/396 R, 292
See application file for complete search history.

(56) References Cited

U.S. PATENT DOCUMENTS 3,579,093 A * 5/1971 Johannessen et al. ..... 323/328
4,134,091 A 1/1979 Rogers
(Continued)

FOREIGN PATENT DOCUMENTS

| | | | |
|---|---|---|---|
| GB | 1 385 867 | A | 3/1975 |
| GB | 2 307 353 | A | 5/1997 |
| GB | 2 415 541 | A | 12/2005 |
| WO | WO 97/49075 | A1 | 12/1997 |
| WO | WO2012108050 | A1 | 8/2012 |

OTHER PUBLICATIONS

Rauls et al., "Design Considerations for High Frequency Co-Axial Winding Power Transformers," Proceedings of the Industry Applications Society Annual Meeting, Dearborn, Sep. 28-Oct. 1, 1991, pp. 946-952.

*Primary Examiner* — Kiet T Nguyen
(74) *Attorney, Agent, or Firm* — Charles B. Katz

(57) ABSTRACT

An RF transformer for supplying power as part of a tank circuit, comprising: a primary side, having at least one main winding and at least one shorting winding, the at least one main winding being configured to receive an RF input; a secondary side, having a first winding inductively coupled to the at least one main winding of the primary side and a second winding inductively coupled to the at least one shorting winding of the primary side; and a switching arrangement, adjustable between a first state in which the at least one shorting winding of the primary side is shorted and a second state in which the at least one shorting winding of the primary side is not shorted, such that the resonant frequency of the tank circuit is changed by adjusting between the first and second states.

33 Claims, 8 Drawing Sheets

(56) References Cited

U.S. PATENT DOCUMENTS

| | | | |
|---|---|---|---|
| 4,222,016 | A | 9/1980 | Stock |
| 5,734,163 | A | 3/1998 | Hayashi et al. |
| 6,205,043 | B1 | 3/2001 | Chutjian et al. |
| 2005/0145611 | A1 | 7/2005 | Blankenship et al. |

* cited by examiner

RF TRANSFORMER

CROSS-REFERENCE TO RELATED APPLICATIONS

The present application is a continuation under 35 U.S.C. §120 and claims the priority benefit of co-pending U.S. patent application Ser. No. 13/841,912, filed Mar. 15, 2013. The disclosure of the foregoing application is incorporated herein by reference.

TECHNICAL FIELD OF THE INVENTION

The invention relates generally to RF transformers, and more particularly RF transformers for supplying power as part of a tank circuit.

BACKGROUND OF THE INVENTION

In mass spectrometry, high voltage RF power supplies are widely used for supplying potentials to different ion optical devices, such as mass filters, collision cells, transfer multipoles, etc. Typically, such RF power supplies provide two complementary phases of RF voltage with amplitudes in the range of 100V peak-to-peak to 1 kV peak-to-peak, at frequencies between 0.3 and 3 MHz measured on one phase relative to ground.

From a practical perspective, such RF power supplies are often built on a resonant tank principle. The output inductance of an RF transformer in the RF power supply and the self-capacitance of the ion optical device (as defined at the input) present a resonant tank. Usually, the RF power supply has only one RF transformer with a quality factor (Q) between 100 and 200, a transformation ratio (n) between 30 and 50 and a supply voltage of 24 VDC or 48 VDC. This structure is advantageously simple and keeps the power consumption of the RF stage in the power supply low. The resonant frequency of the tank circuit is described by the well-known formula, $$f = \frac{1}{2\pi\sqrt{LC}},$$

where L is the inductance of the secondary (output) winding of the RF transformer and C is the sum of self-capacitances of the ion optical device and the secondary winding.

Existing RF transformers are mostly built as an air-core coil that allows, by use of an appropriate material for a coil former, to keep the tank resonant frequency stable in view of normal temperature variation. It is relatively unusual for the RF transformer, supplying an ion optical device, to be wound on a ferrite or metal powder core. Whilst such cores provide some advantages, such as compactness and low production costs, there may be significant power losses in such cores and they may cause a relatively high temperature dependency of the resonant frequency.

The RF power supply does not typically provide an output with fixed parameters. The detection mass range in modern mass spectrometers used in life sciences is wide and may vary between 50 Da to 50 kDa or even greater. This range depends upon the most limiting ion optical device within the mass spectrometer. The ratio between the highest to lowest mass measurable in one analysis cycle typically does not exceed 20. As a result, the whole mass range to be analysed is normally divided into a plurality of sub-mass ranges. This is achieved by changing the RF and DC voltages supplied to the ion optical devices for each sub-mass range measurement. Sometimes, it is more effective to change the frequency of the RF voltage simultaneously.

In theory, it is possible to connect additional frequency-setting capacitive or inductive reactances in parallel with the secondary winding of the air-cored RF transformer. An example of such an embodiment is shown in FIG. 1*a*. This comprises an RF generator 10 which provides an input to a transformer 20. The transformer comprises a primary side with a primary winding 21 and a secondary side with a secondary winding 22. In parallel with the secondary winding 22, there is an inductor 30 of inductance $L_{ext}$, which is controlled by a first switch 35. Also in parallel with the secondary winding 22 is a capacitor 40 of capacitance $C_{ext}$, which is controlled by a second switch 45. A capacitance 50 represents the self-capacitance of the ion optical device to which the transformer 20 provides its output. Transformer 20 is air-cored in this case.

Referring next to FIG. 1*b*, there is shown an alternative theoretical embodiment of an RF power supply according to a conventional design. Like the embodiment shown in FIG. 1*a*, this comprises an RF generator 10. Where the same components are identified, identical reference numerals have been used. A magnetic-core based transformer 120 comprises a primary side with a primary winding 121 and a secondary side with a secondary winding 122. The primary winding 121 and secondary winding 122 are inductively coupled via a magnetic core 123. As with FIG. 1*a*, there is provided an inductor 30 controlled by a first switch 35 and a capacitor 40 controlled by a second switch 45, in parallel with the secondary winding 122. These are provided in parallel with the output to the ion optical device, represented by capacitor 50. In addition, there is provided a second inductor 130 (of inductance $L_{ext}'$) controlled by a third switch 135 and a second capacitor 140 (of capacitance $C_{ext}'$) controlled by a fourth switch 145, which are provided in parallel with the primary winding 121 of the transformer 120.

These apparently straightforward methods for changing the resonant frequency of the tank circuit at the output of the RF transformer have problems when implemented. For the embodiment of FIG. 1*a* using an air-core transformer 20, there are two main technical problems. The first switch 35 and second switch 45 are required to cope with high voltages and currents, but without adding significant intrinsic capacitance to the resonant tank. For electro-mechanical switches, the cost, reliability and size needed to match these requirements is not easy. In contrast, semiconductor switches have a large output capacitance, which may exceed the capacitance present without the additional components. Moreover, in order to avoid high power losses in the second inductor 30, this inductor is desirably implemented with an air core. This may mean that the inductor 30 is as big as the RF transformer itself.

For the magnetic-core based transformer embodiment shown in FIG. 1*b*, the commutation of reactances on the secondary side of the transformer has similar problems as described above with reference to the embodiment of FIG. 1*a*. On top of these difficulties, the commutation of reactances on the primary side of the transformer causes further problems. The second inductor 130 and second capacitor 140 desirably have very low intrinsic resistance, preferably 20 mΩ or less, in order to keep the quality factor of the resonant tank sufficiently high.

The output reactances are reflected to the primary side, with a proportionality factor of $n^2$, $$n^2 = \left(\frac{N_p}{N_s}\right)^2,$$

where $N_p$ and $N_s$ are the numbers of turns in respect of the primary winding 121 and secondary winding 122 respectively. Inductances are reflected and become lower by a factor of $n^2$ and capacitances are reflected and become higher by the same factor. Thus, the second capacitor 140 desirably has a low loss at a relatively high capacitance value (up to hundreds of nF) and very low Equivalent Series Resistance (ESR). The inductance of the second inductor 130 also desirably is kept low (sometimes less than 100 nH) and might become lower than the leakage inductance of the RF transformer itself. In addition, the output current of the RF transformer is reflected to the primary side multiplied by a factor of n. This may reach a level of tens of Amperes.

In view of this, the addition of reactances on the primary side of the RF transformer adds at least two further technical difficulties. It is difficult to find high-current inductors or capacitors with high RF quality factors to meet the requirements described above. Moreover, it is difficult to build a magnetic-core based RF transformer with very low leakage inductance. On this basis, there are significant practical challenges to changing the resonant frequency of a high voltage resonant tank using such an RF transformer by simply connecting reactances in parallel. Commercial approaches must set a compromise between minimising power losses and minimising costs. Designing RF transformers for such power supplies to meet both these requirements remains a significant challenge.

SUMMARY OF THE INVENTION

Against this background, the present invention provides an RF transformer for supplying power as part of a tank circuit, comprising: a primary side, having at least one main winding and at least one shorting winding, the at least one main winding being configured to receive an RF input; a secondary side, having a first winding inductively coupled to the at least one main winding of the primary side and a second winding inductively coupled to the at least one shorting winding of the primary side; and a switching arrangement, adjustable between a first state in which the at least one shorting winding of the primary side is shorted and a second state in which the at least one shorting winding of the primary side is not shorted, such that the resonant frequency of the tank circuit is changed by adjusting between the first and second states.

Thus, the resonant frequency of the tank circuit formed using the RF transformer can be adjusted by changing the state of the switching arrangement. This affects the effective inductance on the secondary side and the resonant frequency of the tank circuit is controllable thereby. Since the switching arrangement affects the RF transformer itself rather than reactances coupled electrically in parallel with the transformer, the problem of additional power losses caused by any extra components required is avoided. Moreover, this design of RF transformer is simple and inexpensive to construct, without comprising on the Q factor of the tank circuit.

The term winding can refer to one or more turn interacting with one or more transformer cores. For example, there may be multiple cores and a winding may comprise a single turn on one of the multiple cores. The at least one main winding of the primary side and the at least one shorting winding of the primary side are preferably distinct. A shorting winding of the primary side of the transformer can be shorted using the switching arrangement, whereas in the preferred embodiment, the switching arrangement is not configurable to short a main winding of the primary side of the transformer.

Preferably, the first and second windings of the secondary side are connected in series. More preferably, at least one additional winding is provided on the secondary side, the at least one additional winding being connected in series with the first and second windings.

In the preferred embodiment, the at least one shorting winding of the primary side is galvanically isolated from the at least one main winding of the primary side. This beneficially may mean that the at least one shorting winding of the primary side is not configured to receive the RF input received by the at least one main winding of the primary side. In an alternative embodiment, the at least one main winding of the primary side and the at least one shorting windings of the primary side are connected in series. In either case, the at least one main winding of the primary side optionally comprises a plurality of main windings. Here, all of the plurality of main windings may be connected in series. Additionally or alternatively, the at least one shorting winding of the primary side comprises a plurality of shorting windings. Then, all of the plurality of shorting windings may be connected in series.

Where more than two windings are provided on the secondary side, it is desirable that each main winding of the primary side is inductively coupled to a respective winding of the secondary side. Similarly where a plurality of shorting windings are provided on the primary side, it is desirable that each shorting winding of the primary side is inductively coupled to a respective winding of the secondary side. Preferably, a winding of the secondary side that is inductively coupled to one of the at least one shorting windings of the primary side may also be inductively coupled to one of the at least one main windings of the primary side. This can be advantageous in an RF transformer design which is symmetrical in nature and therefore allows a DC offset input to be provided.

Advantageously, the RF transformer further comprises: at least one core. Then, the at least one main winding and at least one shorting winding of the primary side may be inductively coupled to the first and second windings of the secondary side via the at least one core. Each of the at least one core may be a magnetic core, optionally comprising ferrite or metal powder material. The use of multiple cores implies that the RF transformer may technically comprise multiple transformers, which will be discussed in more detail below.

In the preferred embodiment, the at least one core comprises a first core. Then, at least one main winding of primary side and the first winding of the secondary side may be inductively coupled via the first core. This coupling of at least a first main winding on the primary side and the first winding on the secondary side via a first core may be considered as a first transformer. Additionally, the at least one core may further comprise a second core. Then, at least one shorting winding of the primary side and the second winding of the secondary side may be inductively coupled via the second core. Coupling at least a first shorting winding on the primary side and the second winding on the secondary side via a second core may be considered as a second transformer. Thus, separate cores are provided for the first main winding and the first shorting winding. In another sense, this can be understood as two separate transformers, one relating to the at least one main winding and one relating to the at least one shorting winding. The two transformers are thereby commutated, although not necessarily inductively coupled to one another. This contrasts with the commutated inductances described above and, as previously noted assists in addressing the problems identified with such configurations.

In some embodiments, the at least one main winding of the primary side comprises a further main winding. Then, the first main winding and the further main winding may be connected in series. Additionally or alternatively, the first winding of the secondary side may be connected in series with the second winding of the secondary side. In one embodiment, a DC offset voltage input is located between the first winding and the second winding on the secondary side.

The at least one core of the preferred embodiment further comprises a third core. Then, a second main winding of the primary side and a third winding of the secondary side are inductively coupled via the third core. More preferably, the at least one core further comprises a fourth core. Then, a second shorting winding of the primary side and a fourth winding of the secondary side may be inductively coupled via the fourth core. Hence, separate cores may be provided for the second main winding and the second shorting winding and these cores are also separate from those provided for the first main winding and the first shorting winding in this embodiment.

Preferably, the second and fourth windings of the secondary side are directly electrically connected in series. More preferably, the first winding of the secondary side is connected in series with the second and fourth windings of the secondary side on one side and the third winding of the secondary side is connected in series with the second and fourth windings of the secondary side on the other side. Thus on the secondary side, the first winding is provided in series with the second winding, which is provided in series with the fourth winding and which is provided in series with the third winding.

Advantageously, the number of turns of the first winding is the same as the number of turns of the third winding on the secondary side. Additionally or alternatively, the number of turns of the second winding is the same as the number of turns of the fourth winding on the secondary side.

This may provide a symmetrical configuration. Optionally, a DC offset voltage input is located between the second and fourth windings on the secondary side. Then, a DC offset voltage is beneficially applied between the second and fourth windings on the secondary side. The DC offset voltage may be applied by means of a DC voltage supply.

In preferred embodiments, the at least one main winding of the primary side comprises a further main winding. This further (second in some embodiments, but third in the preferred embodiment) main winding of the primary side and the second winding of the secondary side may be inductively coupled via the second core. This may apply to a number of different embodiments. Additionally in some embodiments, the at least one main winding of the primary side comprises an additional main winding (a fourth main winding of the primary side). This additional (fourth) main winding of the primary side and the fourth winding of the secondary side may be inductively coupled via the fourth core. Again, this further improves the symmetry of the transformer design, so that the RF output can have a DC offset applied.

The design of the core or cores may be tailored to the system requirements. Preferably, each core of the at least one core comprises a stacked arrangement of magnetic core components. In the preferred embodiment, each core of the at least one core comprises at least one coupling closed (loop) core component (advantageously of an annular, ring or rectangular shape) mounted on a tube (preferably metal) having a hollow centre. Then, the at least one main winding of the primary side may comprises a wire passing through the hollow centre of each metal tube of the at least one core. The wire may pass sequentially through the hollow centre of each metal tube of a plurality of cores. Additionally or alternatively, the first winding of the secondary side and the second winding of the secondary side may comprise a wire passing through the hollow centre of each metal tube of the at least one core. Thus, all of the windings of the secondary side may be provided using a single wire.

Each coupling ring is advantageously magnetic and preferably formed from ferrite, metal powder or both.

Preferably, the at least one core comprises first and second cores and the first and second windings of the secondary side comprise a wire wound through the hollow centres of the metal tubes of the first and second cores. This may apply to multiple embodiments. In preferred embodiments, the at least one core further comprises third and fourth cores and a third winding of the secondary side and fourth winding of the secondary side comprise a wire wound through the hollow centres of the metal tubes of the third and fourth cores. In this way, all of the windings of the secondary side may be provided using two wires.

Advantageously, a first shorting winding of the primary side comprises the metal tube of the second core. The metal tube of the second core may have two ends. Then for certain embodiments, the switching arrangement is coupled between the two ends of the metal tube of the second core. Contrastingly, in the preferred embodiment, a first shorting winding of the primary side and a second shorting winding of the primary side comprise the metal tubes of the second and fourth cores and a series connection between a first end of the metal tube of the second core and a first end of the metal tube of the fourth core. Thus, the metal tube may be used as part of the winding. In such embodiments, the switching arrangement may be coupled between a second end of the metal tube of the second core and a second end of the metal tube of the fourth core.

Beneficially, the switching arrangement comprises at least one semiconductor switch. The switch may comprise plurality of semiconductor switches connected in parallel, in series or a combination of series and parallel. Preferably, the switching arrangement comprises first and second semiconductor switches connected in anti-series. Optionally, a point between the two semiconductor switches is coupled to ground or an output of a power supply providing a DC reference voltage. Preferably, the on-state resistance of each semiconductor switch is low and most preferably less than 30 mΩ, 20 mΩ, 10 mΩ or 5 mΩ.

In a second aspect of the present invention, there is provided a power supply for providing a potential to an ion optical device comprising the RF transformer as described herein. Then, the resonant frequency of the tank circuit may be defined by the effective inductance of secondary side of the RF transformer. Optionally, the secondary side of the RF transformer provides the potential to the ion optical device, such that the resonant frequency of the tank circuit is further defined by an effective self-capacitance at the input of the ion optical device to which the potential is supplied.

In respect of all aspects, the invention is especially applicable for use with ion optical devices that (sequentially) transmit ions with a broad range of masses. In such devices, the mass range may not be achieved only by varying the amplitude of the RF potential used in the ion optical device, because arcing (discharge) may occur towards one end of the mass range (possibly, the low-mass end). The invention may be especially advantageous when the multipole is placed in regions where the pressure is relatively high (that may be close to the ion source). The advantage may be greatest when the multipole components (for instance, adjacent rods supplied with voltages of opposite polarity) and pressure conditions are such that the device is operated near the minimum of the Paschen curve (optionally plus or minus 10- or 100- or 1000-times away from the minimum of the Paschen curve). Typical pressures where this becomes a significant factor may be from 10 mbar (1 kPa) to $10^{-4}$ mbar, but more likely around $10^{-1}$ to $10^{-2}$ mbar. The relevant distances of voltage-carrying parts may typically be in the range of 1 mm (from around 0.1 mm or 0.2 mm to around 2 mm to 4 mm) and these distances are typically dictated by necessities of the ion guiding system. The guiding force may decrease with distance of the ions from the RF voltage carrying parts, typically being proportion to the distance to a power greater than one.

A third aspect provides an RF transformer, comprising: at least one transformer core, each transformer core comprising at least one coupling closed core component (possibly of loop shape) mounted on a respective tube having a hollow centre; and a wire winding passing through the hollow centre of each of the tubes of a respective transformer core at least once. Preferably, each tube is metal. Optionally, the wire winding is a primary side wire winding and the RF transformer further comprises a secondary side wire winding passing through the hollow centre of the metal tube of the transformer core at least once. Additionally or alternatively, the wire winding is a secondary side winding and the primary side winding is provided by the metal tube of the core. Each coupling closed core component is advantageously magnetic and preferably formed from ferrite, metal powder or both. In the preferred embodiment, each coupling closed core component is annular, which may include ring or rectangular shapes.

Optionally, a metal tube of at least one transformer core forms a primary side auxiliary winding. The primary side auxiliary winding may further comprise a series connection between at least some of the metal tubes of the plurality of transformer cores.

There is a fourth aspect of the present invention, which provides an ion optics system, comprising: an ion optical device, arranged to be provided with at least one RF potential and at least one DC potential for generation of fields in order to manipulate received ions; a power supply arrangement configured to providing the at least one RF potential and the at least one DC potential to the ion optical device, the power supply arrangement comprising an RF transformer having at least one magnetic core for supplying the at least one RF potential; and a controller, configured to measure one or both of a frequency and an amplitude of the at least one RF potential at the ion optical device, to compare the measured frequency or amplitude with a desired value and to control the power supply arrangement to adjust the at least one DC potential on the basis of the comparison.

Advantageously, the controller is configured to adjust the at least one DC potential so as to compensate for changes in a temperature of the ion optical device and/or the power supply arrangement causing a change in frequency and/or amplitude of the at least one RF potential. Thus, the deviation in the RF field as measured at the ion optical device (such as a multipole ion trap or ion guide) from the desired frequency and/or amplitude may indicate a change in temperature. The DC potential applied to the ion optical device may be adjusted to compensate for that change.

Beneficially, the RF transformer of the power supply arrangement is as described herein. Most preferably, the ion optical device is a multipole device.

In a fifth aspect, there is provided a method of operating an RF transformer to supply power as part of a tank circuit. The RF transformer comprises: a primary side, having at least one main winding and at least one shorting winding; and a secondary side, having a first winding inductively coupled to the at least one main winding of the primary side and a second winding inductively coupled to the at least one shorting winding of the primary side. The method comprises: switching between a first state in which the at least one shorting winding of the primary side is shorted and a second state in which the at least one shorting winding of the primary side is not shorted, the resonant frequency of the tank circuit being changed by adjusting between the first and second states; receiving an RF input at the at least one main winding of the primary side of the RF transformer; and providing an RF output at the secondary side of the RF transformer.

It will be understood that this method aspect can optionally comprise steps or features used to carry out any of the actions described in connection with the RF transformers detailed above. A method of manufacturing an RF transformer, power supply or both in accordance with any of the designs described herein may also be provided.

In a sixth aspect, there is provided a method of controlling an ion optics system, comprising: providing an ion optical device with at least one RF potential and at least one DC potential in order to generate fields for manipulation of received ions, the potentials being provided by a power supply arrangement comprising an RF transformer with at least one magnetic core for supplying the at least one RF potential; measuring one or both of a frequency and an amplitude of the at least one RF potential at the ion optical device; comparing the measured frequency or amplitude with a desired value; and adjusting the at least one DC potential provided by the power supply arrangement on the basis of the comparison. In particular, the step of adjusting may be so as to compensate for changes in a temperature of the ion optical device and/or the power supply arrangement causing a change in frequency and/or amplitude of the at least one RF potential.

Again, it will be appreciated that this method aspect can optionally comprise steps or features used to carry out any of the actions described in connection with the RF transformers detailed above or the method of the fifth aspect.

Finally, any combination of the individual apparatus features or method features described may be implemented, even though not explicitly disclosed.

BRIEF DESCRIPTION OF THE DRAWINGS

The invention may be put into practice in various ways, a number of which will now be described by way of example only and with reference to the accompanying drawings in which.

DETAILED DESCRIPTION OF PREFERRED EMBODIMENTS

Figure 2:
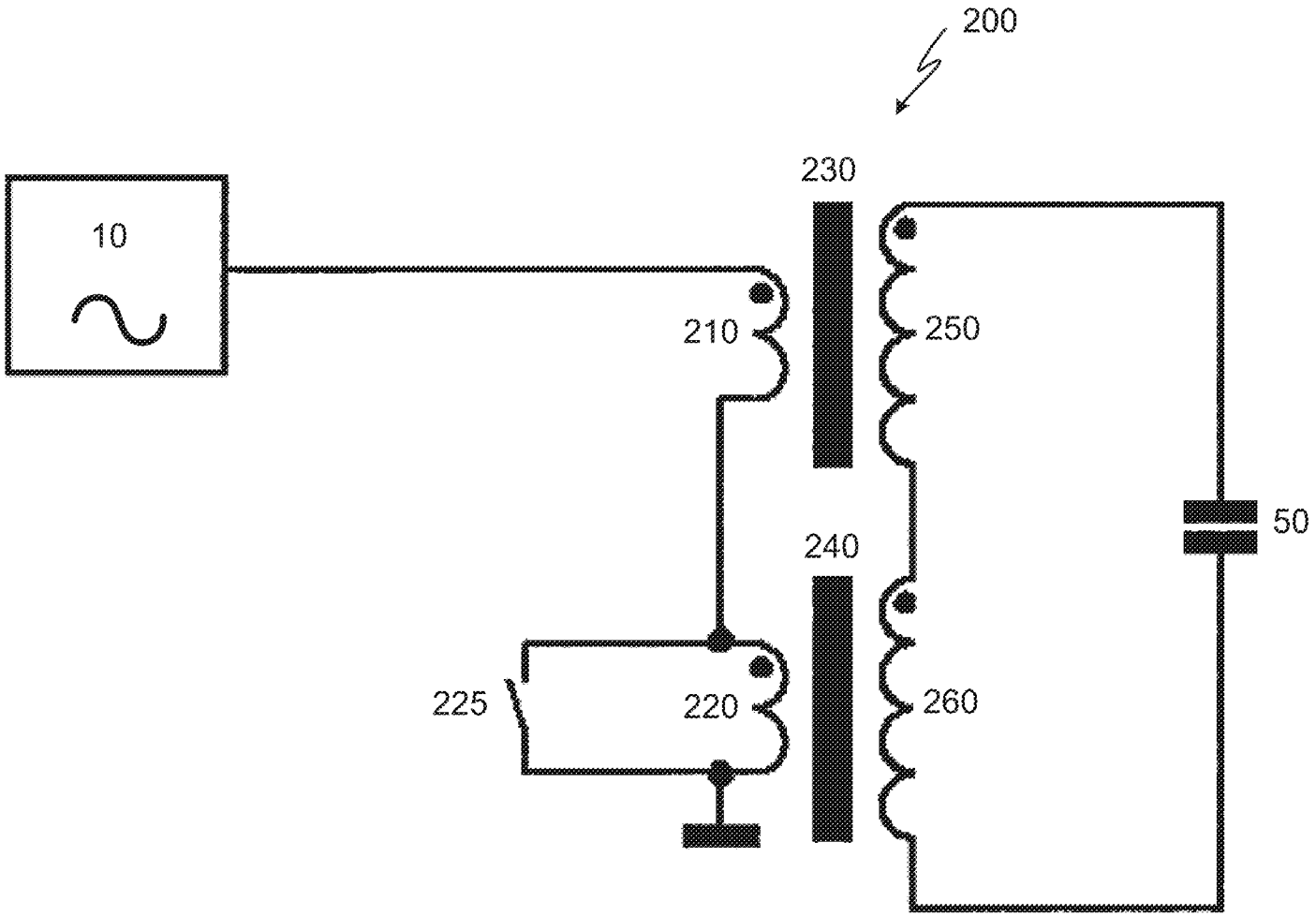
FIG. 2 illustrates a circuit comprising an RF transformer in accordance with a first embodiment of the present invention.

Referring first to FIG. 2, it is illustrated a circuit comprising an RF transformer in accordance with a first embodiment of the present invention. This shows a dual-frequency resonant circuit, which is a simple method of discretely changing the resonant frequency. Where the same components as shown in previous drawings have been illustrated, identical reference numerals have been employed.

The RF transformer 200 is built on basis of two magnetic cores 230 and 240. It comprises, on its primary side, a main winding 210 and a shorting winding 220. On its secondary side, there is provided a first winding 250 and a second winding 260. The main winding 210 on the primary side is inductively coupled to the first winding 250 on the secondary side by a magnetic core 230. Similarly, the shorting winding 220 on the primary side is inductively coupled to the second winding 260 on the secondary side via a magnetic core 240. The shorting winding 220 on the primary side may be shorted by means of a switch 225.

The first magnetic core 230 and second magnetic core 240 have very good inductive coupling properties. The RF transformer 200 can be divided into two transformers, each of which can be described by respective primary inductances ($L_{p1}$, $L_{p2}$), secondary inductances ($L_{s1}$, $L_{s2}$), mutual inductances ($L_{m1}$, $L_{m2}$) and leakage inductances ($L_{l1}$, $L_{l2}$). Moreover, they may be described by respective quality factors (Q), characterising the losses in the respective transformer.

The inductances of the first winding 250 and second winding 260 on the secondary side, together with the capacitance 50 (C) form a resonant tank. The switch 225 can short the shorting winding 220, which is the secondary winding of the second transformer making up the RF transformer 200. This affects the resonant frequency of the tank circuit.

When the switch 225 is open, such that the shorting winding 220 is not shorted, the resonant frequency, $f_L$ is a low value.

$$f_L = \frac{1}{2\pi\sqrt{(L_{s1} + L_{s2})C}}$$

If the switch 225 is closed, such that the shorting winding 220 is shorted, its resistance is transferred to the secondary side, shunting the inductance $L_{s2}$. This reduces the output inductance to the leakage inductance value. The resonant frequency, $f_H$ then becomes higher.

$$f_H = \frac{1}{2\pi\sqrt{(L_{s1} + L_{l2})C}}$$

To reduce power losses in the RF transformer, the intrinsic resistance of the switch 225 should not lower the quality factor of the tank circuit. Normally, the characteristic impedance (Z) of the tank circuit at the resonant frequency is between 1.5 kΩ and 3 kΩ. Thus, the maximum intrinsic series resistance added into the resonant tank circuit should be lower than a specific value, $R_{int_s}$, $$R_{int_s} = \frac{Z}{Q}.$$

For Q=100, this should be between 15Ω and 30Ω.

Reflected to the primary side, the resistance $R_{int_s}$ will be converted to $R_{int_p}$, $$R_{int_p} = \frac{R_{int_s}}{n^2}.$$

This should therefore be less than between 5 to 30 mΩ. Modern semiconductor devices, for example low voltage MOSFETs can provide such low on-state resistances. Consequently, the switch 225 could be implemented in such a fashion.

The ratio between the two frequencies can therefore be written as $$\frac{f_H}{f_L} = \sqrt{\frac{L_{s1} + L_{s2}}{L_{s1} + L_{l2}}}.$$

For magnetic core based transformers, it can be assumed that $L_{l2}$ is much less than $L_{s2}$ ($L_{l2} \ll L_{s2}$). If the frequency ratio is 2 and $L_{l2}$ is much less than $L_{s1}$, the formula for the frequency ratio can be rewritten as $$\frac{f_H}{f_L} \approx \sqrt{1 + \frac{L_{s2}}{L_{s1}}}.$$

Therefore, in order to change the resonant frequency by a factor of 2, the inductance $L_{x2}$ should be three times greater than $L_{s1}$.

A practical implementation of the RF transformer 200 may be complex than as shown in FIG. 2, in order to provide a symmetrical realisation respected to the mid-point of the integrated output winding. The middle point may be used for applying a DC voltage that sets a potential offset desirable for correct operation of an ion optical device.

Figure 3:
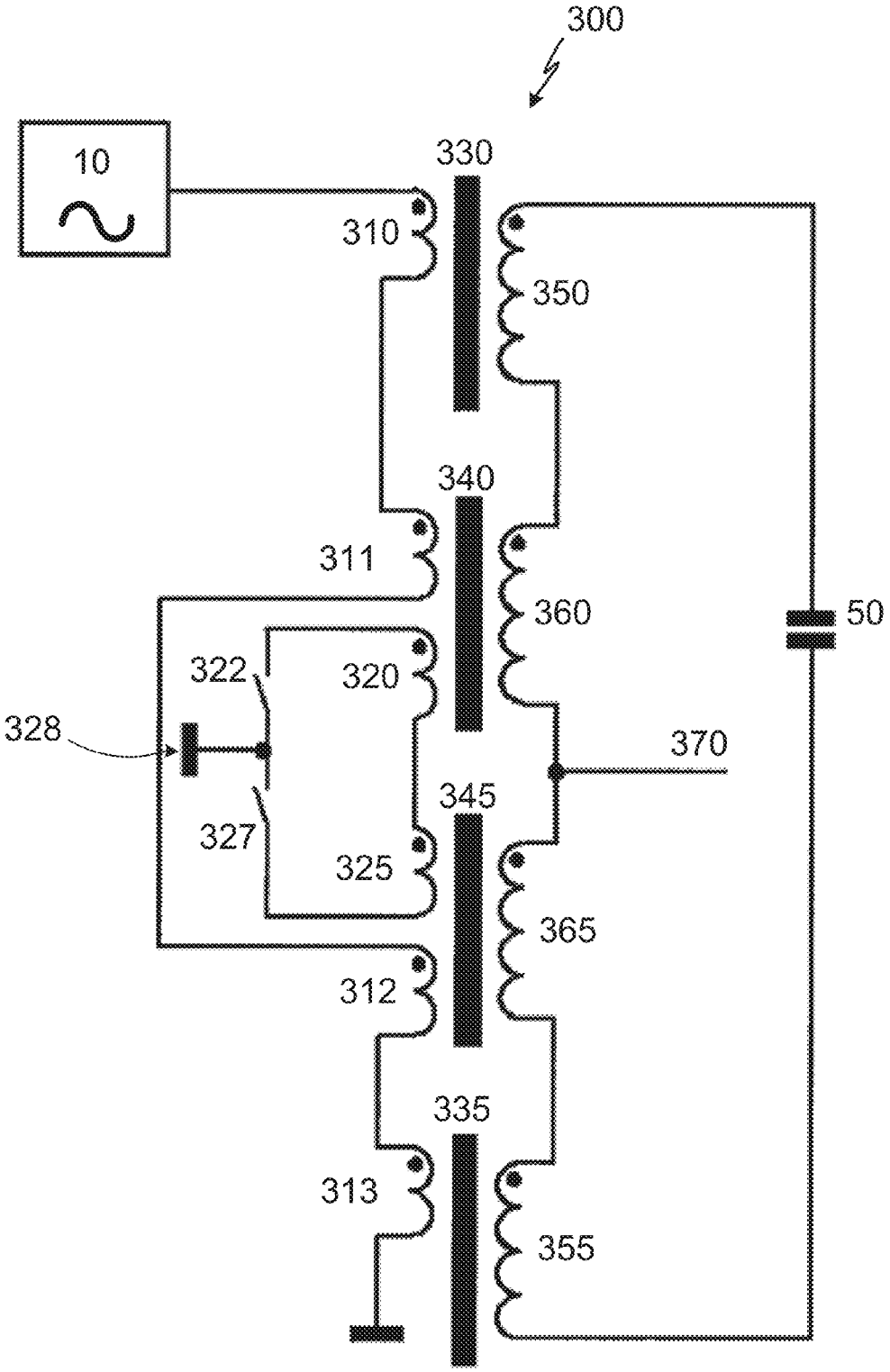
FIG. 3 shows a circuit comprising an RF transformer in accordance with a second embodiment of the present invention.

Referring now to FIG. 3, there is shown a circuit comprising an RF transformer in accordance with a second embodiment of the present invention. This embodiment is in accordance with these practical characteristics. Where the same features are shown as in previous drawings, identical reference numerals have again been used.

In contrast with the RF transformer 200 shown in FIG. 2, RF transformer 300 splits each of the two transformers in FIG. 2 into two parts. This causes a symmetrical design, providing four magnetic cores. Thus, the primary side comprises a first main winding 310, second main winding 311, third main winding 312 and fourth main winding 313, all of which are connected in series. The RF generator 10 provides an output applied across all four main windings in series. A first shorting winding 320 and second shorting winding 325 are also provided on the primary side. The first shorting winding 320 and second shorting winding 325 are galvanically isolated from the first main winding 310, second main winding 311, third main winding 312 and fourth main winding 313 on the primary side. Instead of the single switch 225 of the FIG. 2, a first switch 322 and a second switch 327 are provided. These are semiconductor switches, which are almost always unipolar thus, the first switch 322 and second switch 327 are connected in anti-series. The common point between the first switch 322 and second switch 327 is connected to ground 328. This allows the first switch 322 and second switch 327 to be controlled by the same signal (not shown).

On the secondary side, a first winding 350 is inductively coupled to the first main winding 310 on the primary side through a first magnetic core 330. A second winding 360 on the secondary side is inductively coupled to the second main winding 311 on the primary side and first shorting winding 320 on the primary side via a second magnetic core 340. A third winding 355 on the secondary side is inductively coupled to the fourth main winding 313 on the primary side through a third magnetic core 335. Finally, a fourth winding 365 on the secondary side is inductively coupled to the second shorting winding 325 on the primary side and the third main winding 312 on the primary side via a fourth magnetic core 345. The common point 370 between the second winding 360 and the fourth winding 365 is used for providing a DC offset input.

There are a number of desirable characteristics in the design of high voltage RF magnetic-core based resonant transformers. Firstly, the output inductance of the RF transformer is limited by the resonant frequency at a given self-capacitance. This output inductance should be relatively small. In order to achieve this, the relative permeability (p) of the magnetic core should be small and the number of winding turns for each winding should be low. However, it is also desirable to prevent high losses in the magnetic core material. This requires that the number of turns for each winding and the cross-sectional area of the core should be at least the minimum value.

A transformer having core arrangements made on the basis of stacked magnetic cores can solve this conflict. It is known that magnetic flux density B, which defines losses in magnetic material, is proportional to $1/n \cdot A$; where n is the number of turns and A is the cross-sectional area.

To set a desirable amplitude of output RF voltage, the number of turns should provide a value of B that maintains an acceptable level of losses. In the case of one magnetic core the number of turns can be significant. At the same time the output inductance of the transformer is proportional to $n^2 \cdot A$. If it is assumed that B should be kept constant, it will be possible to increase the cross-sectional area by having k cores (k>1). In order to keep the B value in the core constant, it is desirable to use n/k turns. Therefore, the output inductance of transformer based on k magnetic cores will be proportional to $$\left(\frac{n}{k}\right)^2 \times k \times A = \frac{n^2 \times A}{k}.$$

Thus, stacking k magnetic cores allows a decrease in the output inductance of the RF transformer by the same factor, with reference to the output inductance of a single-core transformer.

Conventional high voltage RF transformers are wound on large RF ferrite rings, for example a ferrite core sold as FT240 (by Amidon, Inc.). This has a size (Do×Di×h) 61×35×12.7 mm and a cross-sectional area of 1.78 $cm^2$. The use of such cores makes it difficult to ensure a good coupling between the primary winding (especially the first shorting winding 320 and second shorting winding 325) which may consist of only one or two turns each and the corresponding secondary side second winding 360 and fourth winding 365. Moreover, such designs of transformer result in the secondary winding covering the core. This makes its thermal conductivity worse. In turn, the temperature of the core is increased.

Figure 4:
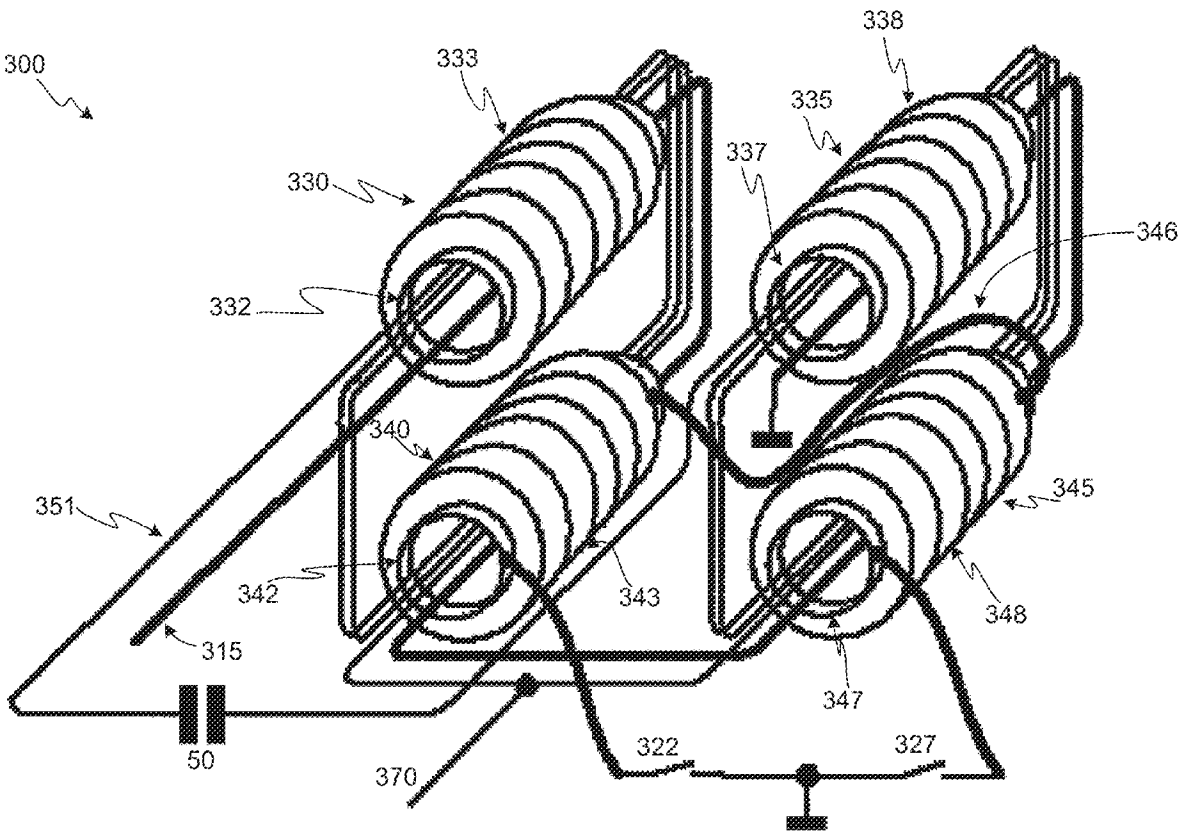
FIG. 4 illustrates a practical implementation of the RF transformer in accordance with the second embodiment shown in FIG. 3.

Referring now to FIG. 4, there is shown a practical implementation of the RF transformer in accordance with the second embodiment shown in FIG. 3. This addresses the design difficulties designed above. Where the same components as illustrated in FIG. 3 are shown, identical reference numerals have again been used.

Each of the first core 330, second core 340, third core 345 and fourth core 335 are manufactured in the same way. Looking at the first core 330 as an example, this comprises a metal tube 332 having a hollow centre. The tube is made from copper. Sitting on the tube are a plurality of ferrite or metal powder rings 333. Similarly, the second core 340 comprises a metal tube 342 upon which are mounted rings 343, the third core 345 comprises metal tube 347 with rings 348 mounted thereupon and the fourth core 335 comprises a metal tube, a wire 337 upon which sit rings 338.

A first wire 315 passes once through each of the hollow centres of the metal tubes of the first core 330, second core 340, third core 345 and fourth core 335. This forms the first main winding 310, the second main winding 311, the third main winding 312 and the fourth main winding 313 of the primary side when passing through a respective core.

A second wire 351 forms the secondary side of the RF transformer 300. This wire passes repeatedly through the hollow centres of the metal tube 332 of the first core 330 and the metal tube 342 of the second core 340, to form the first winding 350 and the second winding 360. The same wire then passes repeatedly through the metal tube 347 of the third core 345 and the metal tube 337 of the fourth core 335 to form the third winding 355 and the fourth winding 365.

The metal tube 342 and metal tube 347 are used as one-turn windings with low ohmic resistance. The metal tube 342 forms the first shorting winding 320 and the metal tube 347 forms the second shorting winding 345. This "co-axial" transformer construction provides very good inductive coupling between all windings, even in the case of a one-turn winding. The first shorting winding 320 and second shorting winding 325 on the primary side are connected together on the rear side by a low resistance wire 346. On the front side, they can be shorted by a first switch 322 and second switch 327.

The first wire 315 is grounded at one end and at the other end connected to an external RF generator.

The second wire 351 acts to unite the different magnetic cores. Thus, it is possible to divide the output inductances only schematically. Nevertheless, the whole output inductance is a sum of all of the output windings of the transformers, since these are all connected in series. In this embodiment, all of the secondary windings have the same number of turns. As a consequence, there is only one way to change the inductance of the part of the transformer formed by the shorting windings. This is by the use of magnetic cores with different relative permeabilities (p).

In order to increase the resonant frequency of the tank circuit by a factor of 2 (by closing first switch 322 and second switch 327), the output inductance of the transformer formed by the shorting windings should be three times greater than the inductance of the transformer formed by the main windings. As a consequence, the permeability of this transformer core should be three times larger as well.

Since the RF transformer uses at least one magnetic core, temperature changes can cause the frequency and/or amplitude of the RF potential supplied to an ion optical device, especially a multipole ion guide or ion trap to vary. Compensation for this temperature variation may be possible by continuous measurement of the RF frequency at the ion optical device. As the frequency changes from the expected value (due to variations in temperature), the RF potential and/or a DC potential provided to the ion optical device can be adjusted to compensate.

The combination of the RF and DC fields sets the conditions to pass through or reject some ions with different m/z ratios. For example, in a quadrupole mass filter or ion trap, all ions except those from a narrow mass range could be ejected when a DC potential of one polarity and a specific magnitude is applied to one pair of opposing rods and a DC potential of the same magnitude but opposite polarity is applied to the other pair of opposing rods. The amplitude of the DC potential may be linked to the amplitude of the RF potential to adjust the range of the remaining masses. If the RF field (RF frequency f or amplitude) has been changed by temperature, it is therefore possible to correct for this by changing the DC voltage. Generally, the behaviour of ions will not be affected if $V_{DC}/f^2$ and $V_{RF}/f^2$ remain unchanged ($V_{DC}$ and $V_{RF}$ being the DC potential amplitude and RF potential amplitude respectively). This correction could slightly affect properties of the ion trap or mass filter, but these changes have been found to be acceptable in practice. Measurement of the frequency with high accuracy allows this compensation to be made.

Figure 5A:
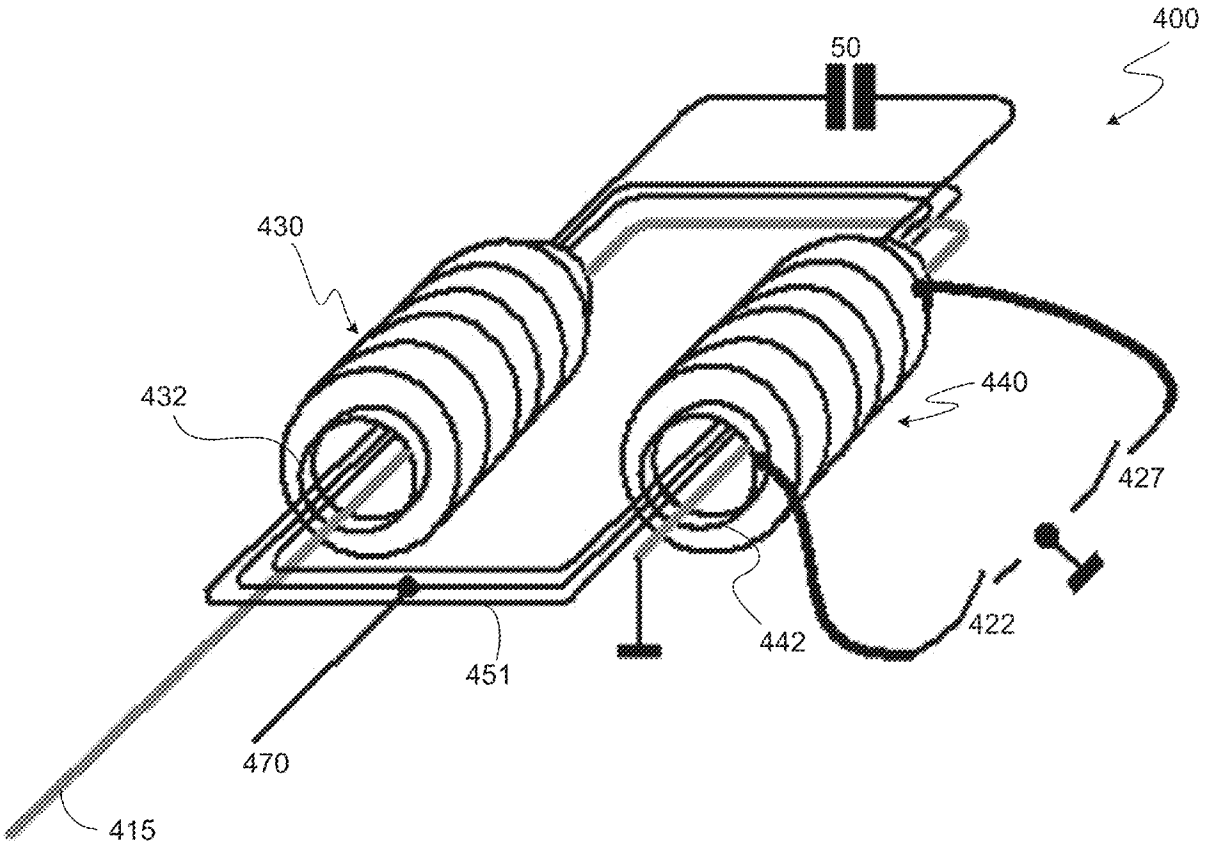
FIG. 5*a* shows a practical implementation of an RF transformer in accordance with a third embodiment.

Referring now to FIG. 5*a*, there is shown a practical implementation of an RF transformer in accordance with a third embodiment. This device illustrates a simple design using two magnetic cores, having only one ferrite "rod" and are united by a common secondary winding.

The RF transformer 400 comprises: a first magnetic core 430; a second magnetic core 440; a first wire 415; and a second wire 451. The first magnetic core 430 comprises a first metal tube 432. The second magnetic core 440 comprises a second metal tube 442.

As with the embodiment shown in FIG. 4, the second metal tube 442 can be shorted by a first switch 422 and second switch 427 (which will normally be semiconductor switches). The mid-point between the switches is grounded in order to ensure a defined potential. The second metal tube 442 thereby forms a primary side shorting winding.

The first wire 415 is connected to an RF generator (not shown) and passes through the first metal tube 432 of the first magnetic core 430 to form a primary side main winding. The first wire 415 then passes through the second metal tube 442 of the second magnetic core 440 to form a primary side shorting winding.

The second wire 451 repeatedly passes through the first metal tube 432 of the first magnetic core 430 and through the second metal tube 442 of the second magnetic core 440, to form a secondary side first winding and secondary side second winding respectively. A mid-point in the second wire 451 is coupled to a DC offset input 470. The two ends of the second wire 451 are coupled to the capacitance 50 (once more representing the self-capacitance of the ion optical device to which the transformer 400 provides its output).

Figure 5B:
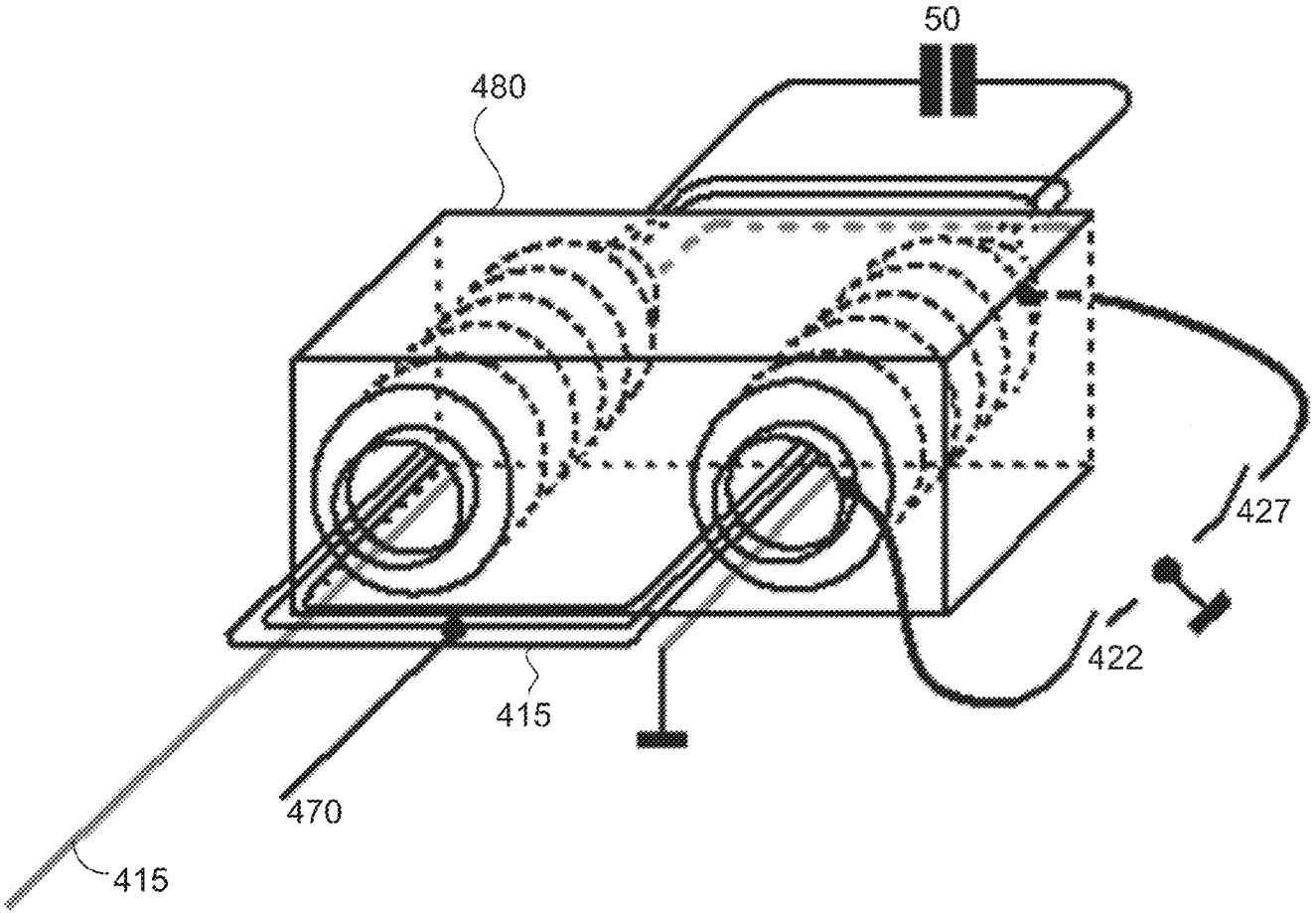
FIG. 5*b* depicts the implementation shown in FIG. 5*a* with a further enhancement.

Referring next to FIG. 5*b*, there is shown the embodiment of FIG. 5*a* with an enhancement. In addition to all of the components of FIG. 5*a*, a housing 480 is provided. This housing 480 is made from aluminium. The housing 480 improves the temperature management of the RF transformer 400. The housing 480 can act as a heat sink.

This implementation can be schematically represented by the same equivalent circuit as illustrated in FIG. 3, with a slight variation. It is assumed that cores 330 and 335 shown in FIG. 3 are in fact only one core 430 of FIGS. 5*a* and 5*b* and cores 340, 345 of FIG. 3 form a core 440 of FIGS. 5*a* and 5*b*.

Figure 6:
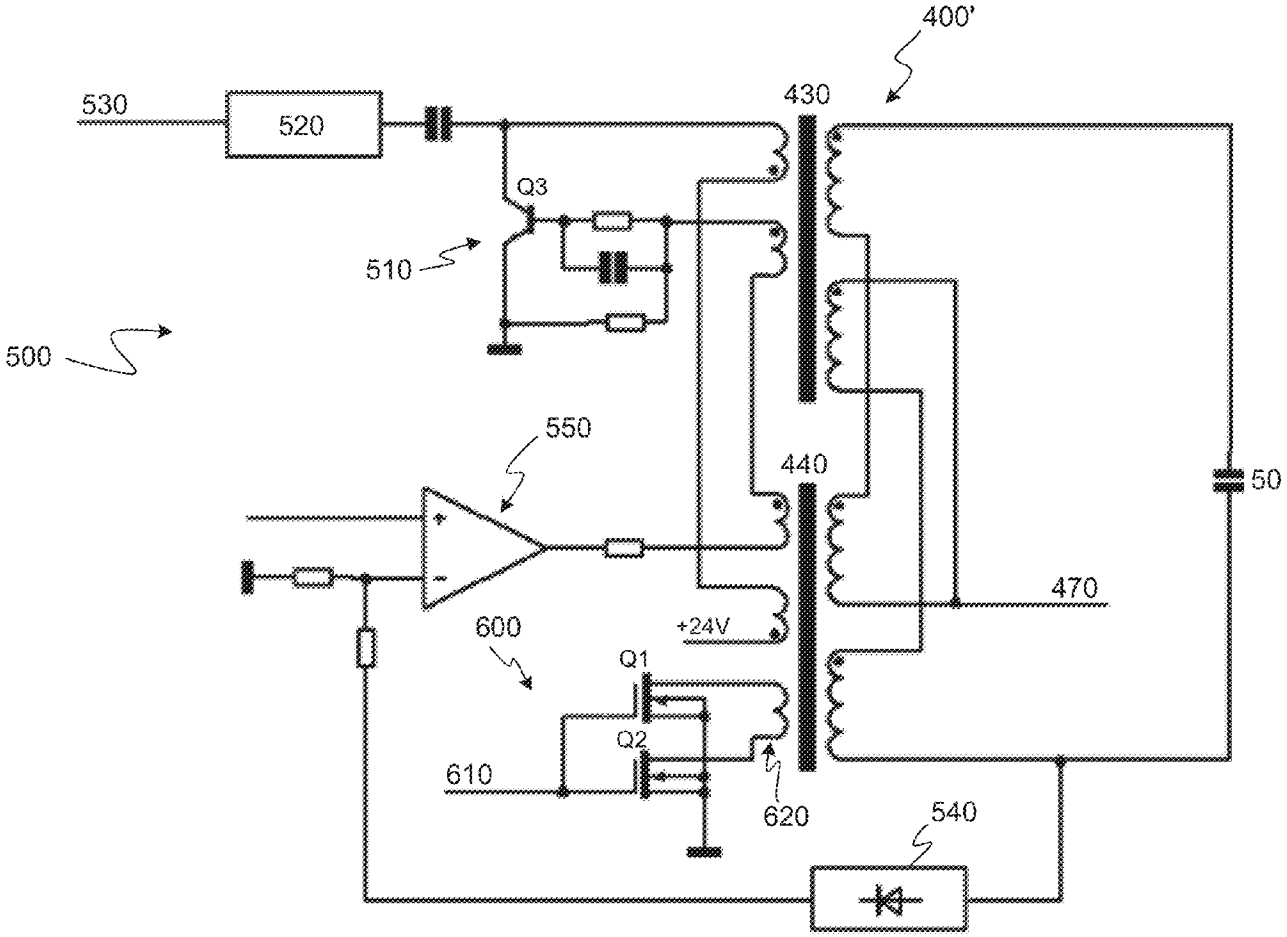
FIG. 6 illustrates a circuit for a prototype RF generator comprising an RF transformer that may be in accordance with the embodiments shown in FIGS. 5*a* and 5*b*.

Referring now to FIG. 6, there is illustrated a circuit for a prototype RF generator 500 comprising an RF transformer 400' that may be in accordance with the embodiments shown in FIGS. 5*a* and 5*b*. The RF generator 500 comprises: an oscillator circuit 510; a frequency monitor 520; a frequency output signal 530; a diode rectifier 540; an amplitude regulator 550 (comprising an operational amplifier); and shorting circuitry 600. The RF transformer 400' uses two cores (a first core 430 and a second core 440), as with the embodiments shown in FIGS. 5*a* and 5*b*. A DC offset input 470 is provided on the secondary side.

The prototype RF generator 500 is a self-oscillating version of an RF power supply, which allows a simple design that changes its frequency automatically using the shorting circuitry 600. The shorting circuitry 600 comprises: a frequency selection signal 610; switching transistors Q1 and Q2; and shorting winding 620. The switching of the transistors Q1 and Q2 in state ON or OFF causes the shorting winding to be either open or shorted dependent on the frequency selection signal 610.

In order to provide a positive feedback for the oscillator 510, an additional feedback winding is wound on first core 430 and second core 440. An output RF voltage across the capacitance 50 is rectified by the diode rectifier 540 and connected to the negative input of the amplitude regulator 550 through a voltage divider.

The RF generator 500 operates on two frequencies: 500 kHz and 1 MHz and may produce two RF voltages 1000 Vpeak-to-peak (p-p) or 1600V p-p across the capacitor 50, which presents the self-capacitance of an ion optical device and the coil. Overall power consumption of the RF generator from 24V supply does not exceed 5 W.

Some data regarding the RF transformer 400' is now provided as guidance. The first core 430 is assembled on basis of 7 stacked ferrite rings FT82-67 (Amidon inc.) and has an AL value (relative self-inductance) of 154 nH (22 nH each ring). The second core 440 has 7 rings FT82-61 (from the same manufacturer) and one turn with AL value of 525 nH (75 nH for one ring). All of the primary side windings have one turn only. Each secondary side winding has 27 turns, such that the transformer ratio, n, is 54. Both stacked ferrite cores 430 and 440 have been put in to an aluminum housing with length 49 mm, width 45 mm and height 28 mm.

The inductance of the whole secondary winding of the first core 430 is $L_{s1}=A_L \times n^2=154\times 2916=449$ μH. For the secondary windings of the second core 440, $L_{s2}=A_L \times n^2=525\times 2916=1531$ μH.

The operating frequencies can be determined as follows. The capacitance 50 (representing the ion optics and self-capacitance of the RF transformer) is 51 pF. The measured leakage inductance of the secondary winding on the second core 440 is $L_{l2}=40$ μH. Then, the lower frequency, $f_L$, is given by the following expression.

$$f_L = \frac{1}{2\pi\sqrt{(L_{s1}+L_{s2})C}} = \frac{1}{2\pi\sqrt{1.98\times 10^{-3}\times 51\times 10^{-12}}} = 500.8 \text{ kHz}$$

The higher frequency, $f_H$, is given by the following expression.

$$f_H = \frac{1}{2\pi\sqrt{(L_{s1}+L_{l2})C}} = \frac{1}{2\pi\sqrt{(489\times 10^{-6})51\times 10^{-12}}} = 1.001 \text{ MHz}$$

The switches Q1 and Q2 are MOSFETS IRL3705NS (International Rectifier). These have: $V_{DSS}=55$V; and $R_{DS(on)}=0.015$. The low ON resistance of 10 mΩ allows a high quality factor (Q>50) for the RF transformer to be maintained when it operates at the higher frequency.

The invention, in a general sense, is applicable to use with a wide variety of ion optical devices and in a range of different mass spectrometry instruments. For example, in the instruments illustrated in FIGS. 8 and 9 of US-2010/224774 (commonly assigned with the present invention; this document also being hereby incorporated by reference), the invention may be used for the supply to RF potentials of variable frequency for the multipole devices (shown with reference numerals 30 and 33 in that publication). In particular, the multipole device shown with reference numeral 30 advantageously benefits from the present invention, as it is closer to the ion source.

Figure 1A:
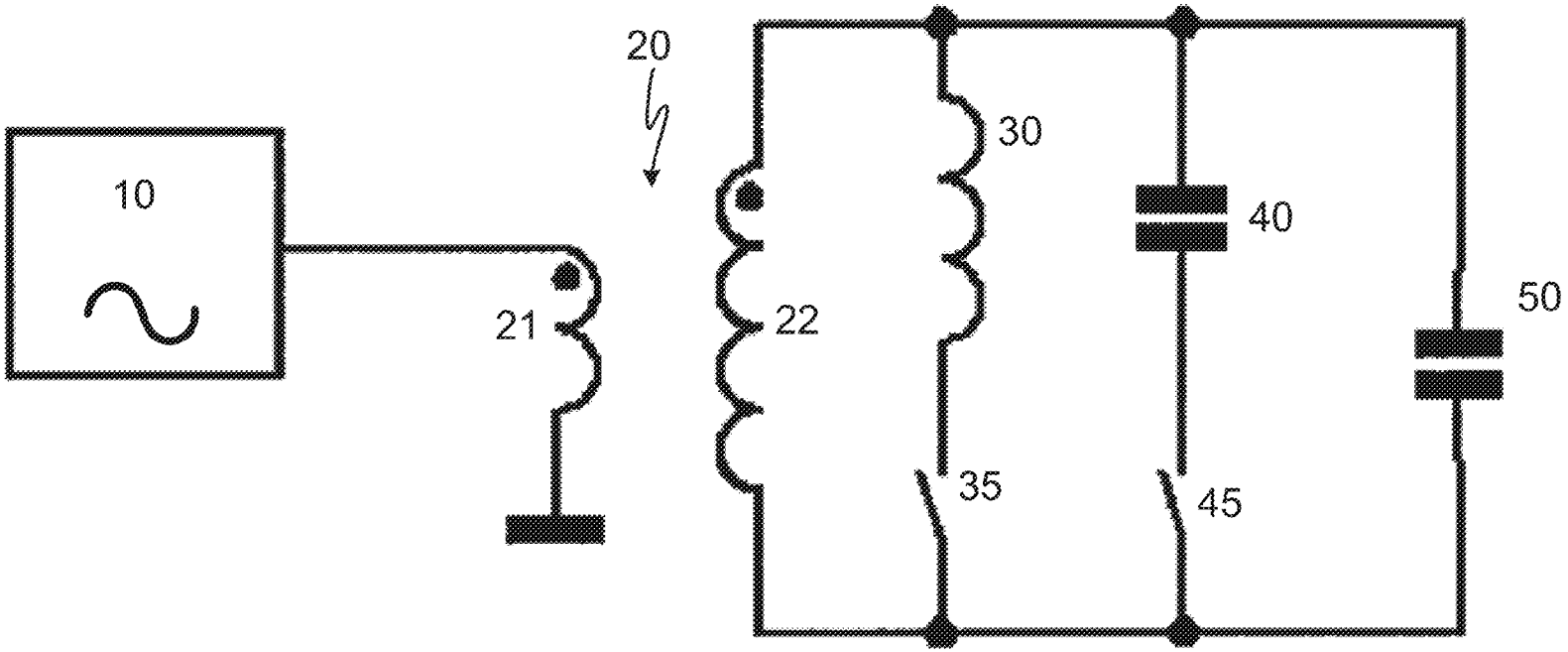
FIG. 1A (Prior Art)
FIG. 1*a* shows a known circuit for connecting additional frequency-setting reactive components in parallel with an air-cored RF transformer.
Figure 1B:
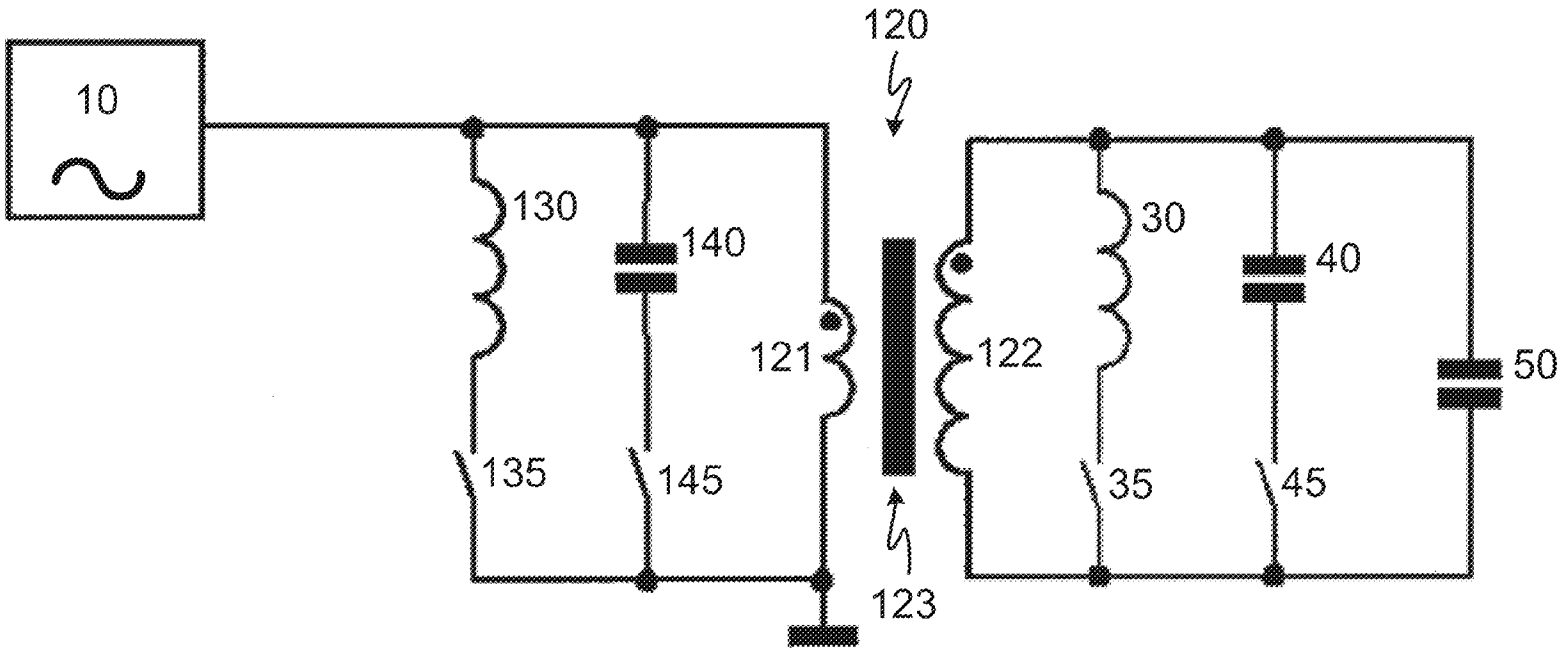
FIG. 1B (Prior Art)
FIG. 1*b* depicts a known circuit for connecting additional frequency-setting reactive components in parallel with a magnetic-cored RF transformer.

The invention is especially applicable for the injection multipole illustrated in FIG. 1 of GB2490958 (application number GB1108473.8, commonly assigned with the present invention; this document also being hereby incorporated by reference). This instrument is marketed under the brand name 'Exactive' by Thermo Fisher Scientific, Inc. However, it may also be applicable to the bent flatapole (labelled as 12), the Stacked Ring Ion Guide (SRIG, labelled as 8) shown next to it and the collision cell ("HCD multipole", labelled as 50) or any device upstream from the mass resolving quadrupole ion optical device (labelled as 18).

The invention may further be useful in the instrument shown in FIG. 1 of WO-2009/147391 (commonly assigned with the present invention; this document also being hereby incorporated by reference). In particular, everything to upstream of the linear ion trap or "high pressure trap" (C-trap labelled as 40) and the HCD collision cell (labelled as 50) would be possible uses for the invention. Similarly, the invention may be used in the instrument shown in FIG. 2 of US-2009/173880 and FIGS. 2 and 6 of US-2011/049357 (both of which are incorporated by reference). The invention may also be applied to ion-mobility separation and stacked plate ion guides where the plates are parallel or orthogonal to the direction of ion movement.

Although embodiments of the invention have been described above, the skilled person may contemplate various modifications or substitutions. For example, embodiments with two transformer cores and four transformer cores have been described above. However, the skilled person would understand that other numbers of transformer cores may be used. In particular, any even number of transformer cores might be implemented to extend the embodiment shown in FIG. 3.

Additionally or alternatively, different numbers of turns may be used for the individual windings. Where indicated that a point in the circuit is connected to ground, this may equivalently be connected to a DC reference voltage, if appropriate.

Whereas the embodiments described above have shown dual-frequency resonant circuits, the skilled person will understand that more than two different resonant frequencies may be selected by providing more than one set of shorting windings, each of which may be individually or collectively shorted by means of a switching arrangement. In principle, a set of N main windings and N−1 shorting windings controlled by N−1 switches may make it possible to provide $2^N$ different frequencies accordingly.

The invention claimed is:

1. An RF transformer for supplying power as part of a tank circuit, comprising:

a primary side, having at least one main winding and at least one shorting winding, the at least one main winding being configured to receive an RF input;

a secondary side, having a first winding inductively coupled to the at least one main winding of the primary side and a second winding inductively coupled to the at least one shorting winding of the primary side; and a switching arrangement, adjustable between a first state in which the at least one shorting winding of the primary side is shorted and a second state in which the at least one shorting winding of the primary side is not shorted, such that the resonant frequency of the tank circuit is changed by adjusting between the first and second states.

2. The RF transformer of claim 1, wherein the first winding of the secondary side and the second winding of the secondary side are connected in series.

3. The RF transformer of claim 1, wherein the at least one shorting windings of the primary side are galvanically isolated from the at least one main winding of the secondary side.

4. The RF transformer of claim 1, wherein one of the at least one main windings of the primary side is inductively coupled to the second winding of the secondary side.

5. The RF transformer of claim 1, further comprising:

at least one core, the at least one main winding and at least one shorting winding of the primary side being inductively coupled to the first winding and the second winding of the secondary side via the at least one core.

6. The RF transformer of claim 5, wherein the at least one core comprises a first core, at least one main winding of the primary side and the first winding of the secondary side being inductively coupled via the first core.

7. The RF transformer of claim 6, wherein the at least one core further comprises a second core, at least one shorting winding of the primary side and the second winding of the secondary side being inductively coupled via the second core.

8. The RF transformer of claim 7, wherein the at least one main winding of the primary side comprises a first main winding and a further main winding, the first main winding and the further main winding being connected in series and wherein the first winding of the secondary side is connected in series with the second winding of the secondary side.

9. The RF transformer of claim 8, further comprising a DC offset voltage input located between the first winding and the second winding on the secondary side.

10. The RF transformer of claim 7, wherein a first main winding of the primary side and the first winding of the secondary side are inductively coupled via the first core and wherein the at least one core further comprises a third core, a second main winding of the primary side and a third winding of the secondary side being inductively coupled via the third core.

11. The RF transformer of claim 10, wherein a first shorting winding of the primary side and the second winding of the secondary side are inductively coupled via the second core and wherein the at least one core further comprises a fourth core, a second shorting winding of the primary side and a fourth winding of the secondary side being inductively coupled via the fourth core.

12. The RF transformer of claim 10, wherein the second and fourth windings of the secondary side are directly electrically connected in series.

13. The RF transformer of claim 12, wherein the first winding of the secondary side is connected in series with the second and fourth windings of the secondary side on one side and wherein the third winding of the secondary side is connected in series with the second and fourth windings of the secondary side on the other side.

14. The RF transformer of claim 13, further comprising a DC offset voltage input located between the second and fourth windings on the secondary side.

15. The RF transformer of claim 7, wherein the at least one main winding of the primary side comprises a further main winding and wherein the further main winding of the primary side and the second winding of the secondary side are inductively coupled via the second core.

16. The RF transformer of claim 7, wherein a first main winding of the primary side and the first winding of the secondary side are inductively coupled via the first core and wherein the at least one core further comprises a third core, a second main winding of the primary side and a third winding of the secondary side being inductively coupled via the third core, and wherein a first shorting winding of the primary side and the second winding of the secondary side are inductively coupled via the second core and wherein the at least one core further comprises a fourth core, a second shorting winding of the primary side and a fourth winding of the secondary side being inductively coupled via the fourth core, and further wherein the at least one main winding of the primary side comprises an additional main winding and wherein the additional main winding of the primary side and the fourth winding of the secondary side are inductively coupled via the fourth core.

17. The RF transformer of claim 5, wherein each core of the at least one core is a magnetic core.

18. The RF transformer of claim 17, wherein each core of the at least one core comprises a stacked arrangement of magnetic core components.

19. The RF transformer of claim 17, wherein each core of the at least one core comprises at least one magnetic coupling closed core component mounted on a metal tube having a hollow centre.

20. The RF transformer of claim 19, wherein the at least one main winding of the primary side comprises a wire passing through the hollow centre of each metal tube of the at least one core.

21. The RF transformer of claim 19, wherein the first and second windings of the secondary side comprise a wire passing through the hollow centre of each metal tube of the at least one core.

22. The RF transformer of claim 21, wherein the at least one core comprises first and second cores and wherein the first and second windings of the secondary side comprise a wire wound through the hollow centres of the metal tubes of the first and second cores.

23. The RF transformer of claim 22, wherein a first shorting winding of the primary side comprises the metal tube of the second core.

24. The RF transformer of claim 23, wherein the metal tube of the second core has two ends, the switching arrangement being coupled between the two ends of the metal tube of the second core.

25. The RF transformer of claim 21, wherein the at least one core further comprises third and fourth cores and wherein a third winding of the secondary side and fourth winding of the secondary side comprise a wire wound through the hollow centres of the metal tubes of the third and fourth cores.

26. The RF transformer of claim 25, wherein a first shorting winding of the primary side and a second shorting winding of the primary side comprise the metal tubes of the second and fourth cores and a series connection between a first end of the metal tube of the second core and a first end of the metal tube of the fourth core.

27. The RF transformer of claim 26, wherein the switching arrangement is coupled between a second end of the metal tube of the second core and a second end of the metal tube of the fourth core.

28. The RF transformer of claim 1, wherein the switching arrangement comprises at least one semiconductor switch.

29. The RF transformer of claim 28, wherein the switching arrangement comprises first and second semiconductor switches connected in anti-series.

30. The RF transformer of claim 29, wherein a point between the two semiconductor switches is coupled to ground or an output of a power supply providing a DC reference voltage.

31. A power supply for providing a potential to an ion optical device, comprising:

an RF transformer for supplying power as part of a tank circuit, the RF transformer including:

a primary side, having at least one main winding and at least one shorting winding, the at least one main winding being configured to receive an RF input;

a secondary side, having a first winding inductively coupled to the at least one main winding of the primary side and a second winding inductively coupled to the at least one shorting winding of the primary side; and a switching arrangement, adjustable between a first state in which the at least one shorting winding of the primary side is shorted and a second state in which the at least one shorting winding of the primary side is not shorted, such that the resonant frequency of the tank circuit is changed by adjusting between the first and second states;

wherein the resonant frequency of the tank circuit is defined by the effective inductance of secondary side of the RF transformer.

32. The power supply of claim 31, wherein the secondary side of the RF transformer provides the potential to the ion optical device such that the resonant frequency of the tank circuit is further defined by an effective self-capacitance at the input of the ion optical device to which the potential is supplied.

33. A method of operating an RF transformer to supply power as part of a tank circuit, wherein the RF transformer comprises: a primary side, having at least one main winding and at least one shorting winding; and a secondary side, having a first winding inductively coupled to the at least one main winding of the primary side and a second winding inductively coupled to the at least one shorting winding of the primary side, the method comprising:

switching between a first state in which the at least one shorting winding of the primary side is shorted and a second state in which the at least one shorting winding of the primary side is not shorted, the resonant frequency of the tank circuit being changed by adjusting between the first and second states;

receiving an RF input at the at least one main winding of the primary side of the RF transformer; and providing an RF output at the secondary side of the RF transformer.

* * * * *